US008544673B1

(12) United States Patent
Polk

(10) Patent No.: US 8,544,673 B1
(45) Date of Patent: Oct. 1, 2013

(54) DUAL BIN WASTE RECEPTACLE

(71) Applicant: Sandra Polk, Miami, FL (US)

(72) Inventor: Sandra Polk, Miami, FL (US)

( * ) Notice: Subject to any disclaimer, the term of this patent is extended or adjusted under 35 U.S.C. 154(b) by 0 days.

(21) Appl. No.: 13/625,736

(22) Filed: Sep. 24, 2012

(51) Int. Cl.
*B65D 25/14* (2006.01)

(52) U.S. Cl.
USPC ..... 220/495.09; 220/212.5; 220/254.3; 220/326; 220/495.06; 220/524; 220/532; 220/769; 220/840; 220/908.1; 220/909; 383/33

(58) Field of Classification Search
USPC ..... 220/212.5, 254.3, 326, 495.06, 495.09, 220/524, 532, 553, 769, 908.1, 909; 383/33
See application file for complete search history.

(56) References Cited

U.S. PATENT DOCUMENTS

| | | | | |
|---|---|---|---|---|
| 4,821,903 | A | 4/1989 | Hayes | |
| 5,005,727 | A * | 4/1991 | Roth | 220/495.09 |
| 5,044,644 | A | 9/1991 | Duran | |
| D322,703 | S * | 12/1991 | Dosunmu | D34/7 |
| 5,072,852 | A | 12/1991 | Smith | |
| D324,933 | S | 3/1992 | Giacobe | |
| D333,026 | S | 2/1993 | Befus | |
| 5,303,841 | A | 4/1994 | Mezey | |
| 5,611,270 | A | 3/1997 | Harrington | |
| 5,718,168 | A | 2/1998 | Harrington | |
| 6,050,442 | A | 4/2000 | Wysocki | |
| 6,138,558 | A | 10/2000 | Harrington | |
| 7,290,674 | B1 | 11/2007 | Ledford | |
| D604,472 | S | 11/2009 | Blanks | |
| D627,124 | S | 11/2010 | Bowling | |
| 2005/0258177 | A1 * | 11/2005 | Woodson | 220/495.07 |
| 2006/0124643 | A1 * | 6/2006 | Markert et al. | 220/254.3 |

* cited by examiner

*Primary Examiner* — Anthony Stashick
*Assistant Examiner* — Elizabeth Volz
(74) *Attorney, Agent, or Firm* — Christopher J. Vandam, PA; Chris Vandam

(57) ABSTRACT

A dual bin waste receptacle is disclosed having a bin assembly comprised of a pair of bins sharing a single divider between them. The bins are waterproof and leak proof. The tops of each respective bin has a continuous rim that a trash liner may be folded over. A complementary dual lid assembly is also provided that snaps onto the bin assembly thereby pinching both of the trash liners. The lid assembly is hinged in the middle, essentially over the divider that allows access to and trash liner removal from each side independently.

3 Claims, 3 Drawing Sheets

DUAL BIN WASTE RECEPTACLE

BACKGROUND OF THE INVENTION

1. Field of the Invention

The present invention relates to household garbage and recycling storage, and more particularly, to a dual bin waste receptacle including a complementary lid for garbage and recycling sorting and storage.

2. Description of the Related Art

Several designs for garbage cans have been designed in the past. None of them, however, includes a dual bin design suitable for household use that includes features to hold securely a disposable bin liner while permitting easy access to either of two bins while not disturbing or opening the other adjacent bin.

Applicant believes that the closest reference corresponds to U.S. Pat. No. 7,290,674 issued to Ledford. However, it differs from the present invention because the present improvements include the ability to keep one of the sides closed while servicing the opposite side as well as providing an improved means to secure a liner (also referred to as a garbage bag, trash liner or bag) to the tops of the bins while remaining robust.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a device that encourages household recycling by improving the ease in which a user can separate recyclables from refuse.

It is another object of this invention to provide a sanitary device that is easy to clean and easy to keep clean with garbage bags held securely by the lids.

It is still another object of the present invention to provide a device that is simple to use and is attractive to home owners.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
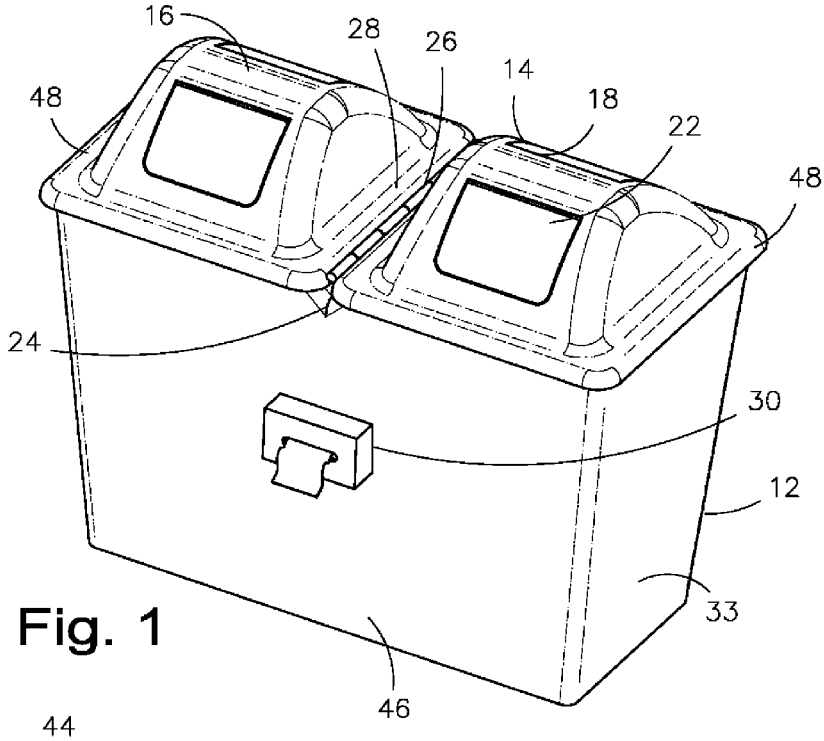
FIG. 1 represents a perspective view of a version of the device as it might be in actual use.
Figure 2:
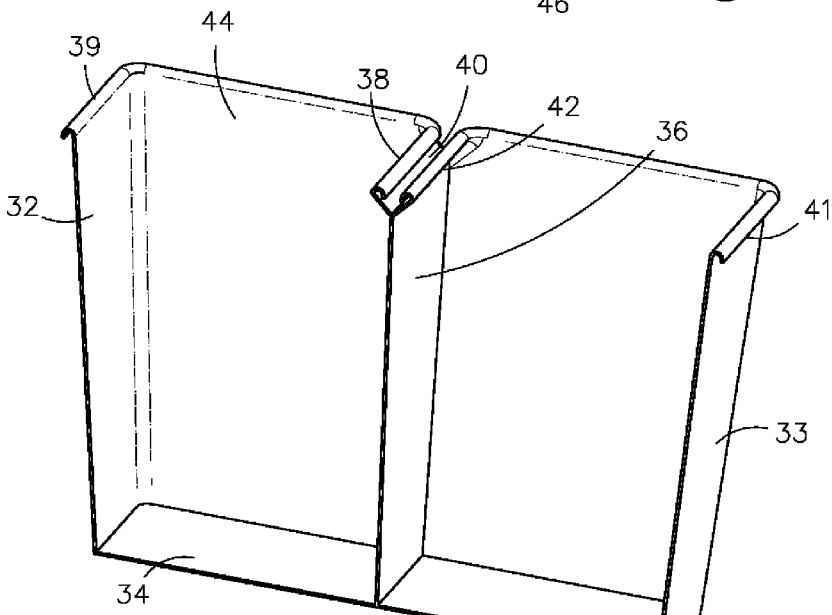
FIG. 2 shows a perspective cross-sectional view of a bin assembly.

Referring now to the drawings, where the present invention is generally referred to with numeral 10, it can be observed that it basically includes a bin assembly 12 and a lid assembly 14.

The bin assembly 12 is further comprised of, among other elements, a dispenser 30, a sidewall 32, a sidewall 33, a base 34, a divider 36, a rim 38, a rim 39, a gap 40, a rim 41, a rim 42, a back 44 and a front 46.

Generally, the bin assembly 12 is comprised of an open-topped box bounded by the base 34 forming a bottom panel, a front 46 forming a front panel, a sidewall 32 and sidewall 33 forming a left and right side panels, respectively, and a back 44 forming the back panel.

The base 34, sidewalls 32 and 33, front 46 and back 44 together form essentially an open topped, two part box. The addition of a divider 36 that connects the front 46 to the back 44, as well as the bottom 34, divides the bin assembly 12 into a first and second bin. The two bins are substantially identical, but mirror images of each other.

The bin assembly 12 is preferably made of a unitary construction of a semi-rigid and water-proof material. For example, the bin assembly 12 may be made of sheet metal, plastic, other polymer or combination thereof. Other materials could also conceivably be used as may become available, but any material should be strong and stiff enough to support the weight of any contained garbage and also be able to contain odors and liquids that may be placed inside.

Figure 4:
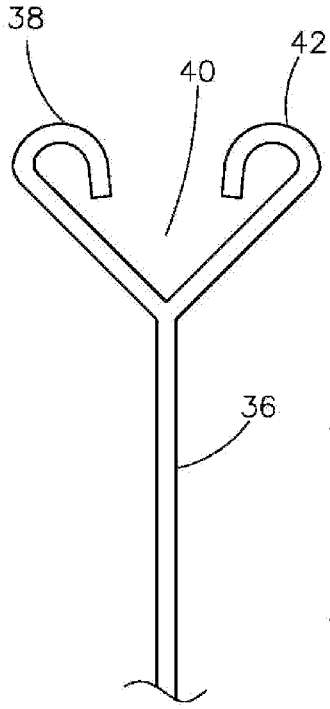
FIG. 4 is a representation of a partial elevation view of a portion of a bin assembly.
Figure 5:
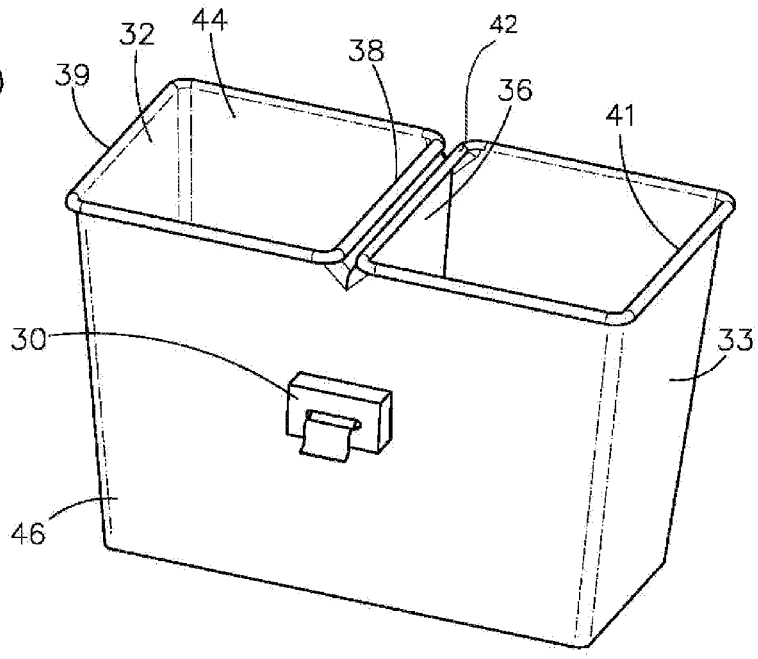
FIG. 5 a perspective view of a version of a bin assembly.

Referring now to FIGS. 4 and 5 where the divider 36 is shown in more detail, a top edge of the bin assembly 12 on the first bin is bounded by the rim 38 and rim 39 and on the second bin by rim 41 and rim 42. At the top of the divider 36, a gap 40 separates the rim 38 and the rim 42. This feature allows a trash liner to be set inside either the first or second bin and be fully wrapped over the respective rims 38 and 39 for the first bin and the second bin at rims 41 and 42.

The divider 36 is present to provide a structure for any trash liner placed in either side of the bin assembly 12 as well as to isolate any spillage of liquid or solids in one side from traveling to the other side. This can reduce the effort required to clean a spill and also to prevent cross-contamination between the two sides of the bin assembly 12 when used for containing different types of garbage. For example, food waste intended for composting should typically not be in contact with other garbage intended for disposal.

Figure 3:
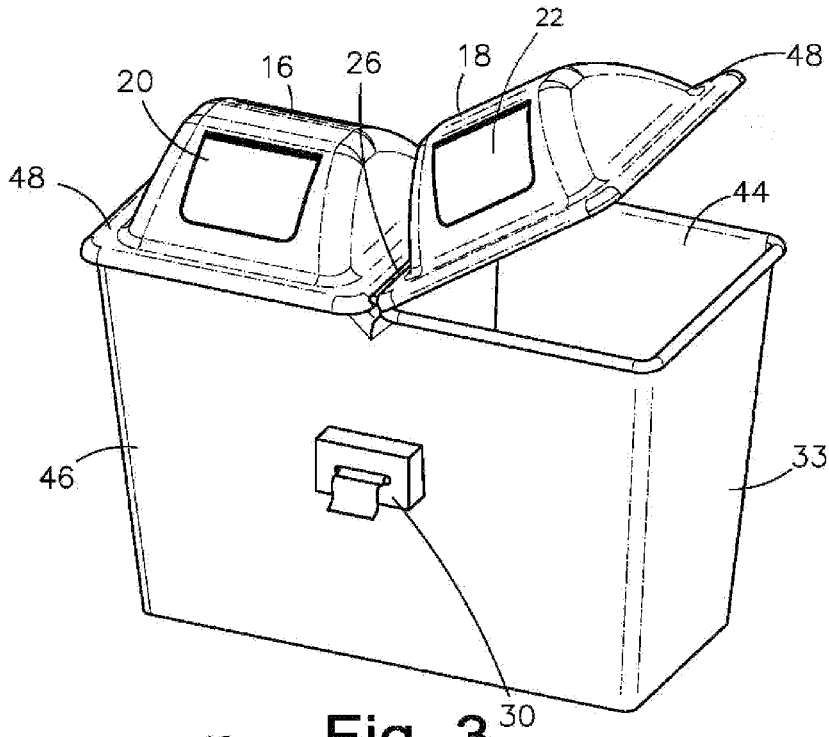
FIG. 3 illustrates a perspective view of a version of the device as it might be in use with a partially opened lid assembly.

Referring to FIG. 3, the dispenser 30 is optionally provided on the exterior of the bin assembly 12. The dispenser 30 can hold a reserve supply of garbage bags in a convenient position to aid the user in easily removing the content of the bin assembly 12 and replacing the garbage bag with a new, clean trash bag readying the device for continued use.

The dispenser 30 may have a hinged or lidded cover to allow a refill of a new package of garbage bags when the supply contained therein is exhausted. In a preferred version of the device the dispenser 30 is dimensioned to a standard size of garbage bag bulk pack. This may encourage use of any particular brand of garbage bags which may have an added value for a manufacturer of the device.

Also shown in FIG. 3 is the hinging action of the lid assembly 14. The first and second bins may be each individually accessed by lifting the outside edge of the crown 48. The portion of the lid assembly 14 over that bin can then be accessed without disturbing the other bin. In a preferred version of the device the lid assembly 14 for each side independently snaps tightly onto the respective rims 38 and 39 as well as the rims 41 and 42. This is useful, for example, when one side of the bin is changed out more frequently or has an odorous content that the user prefers not to disturb until absolutely necessary.

Another advantage of independently operable lids is that the liner on one side can be removed with the benefit of the weight of the opposing side. As often happens when emptying a prior art garbage can by removing the liner, the liner is over stuffed and is somewhat difficult to remove. For prior art devices the user then has to try to hold the can to the floor to pry the bag out. In the present invention the weight of the garbage in the side that it not then being removed holds the can down so plenty of force can more easily be applied to remove a stubborn liner from the other side without holding the bin assembly 12 down with their feet or some other cumbersome means.

The lid assembly 14 is further comprised of, among other elements, a cover 16, a cover 18, a door 20, a door 22, a seam 24, a hinge 26, a margin 28, a crown 48, a flange 52, a flange 54 and a flange 56.

Generally, the lid assembly 14 is a unified assembly of cover 16 connected to cover 18 at the hinge 26. The lid assembly 14 is dimensioned to attach onto the top of the bin assembly 12. The crown 48 is configured to engage the rim 39 on a first side and the rim 41 on the second side. Above the divider 36, the lid assembly 14 at the flange 52 engages the rim 38 and the flange 54 engages the rim 42. The crown 48 creates a generally air and odor proof seal at the intersection between the lid assembly 14 and the bin assembly 12.

Doors 20 and 22 independently open, one each over the first and second bins, respectively. In a preferred version the doors 20 and 22 are biased closed with the force of gravity. Alternate versions using springs or elastic bands may also be used. Doors 20 and 22 are preferably relatively tight fitting to avoid the escape of odors and preventing the intrusion of insects yet remaining freely movable so that refuse may be easily inserted into the bins.

Figure 6:
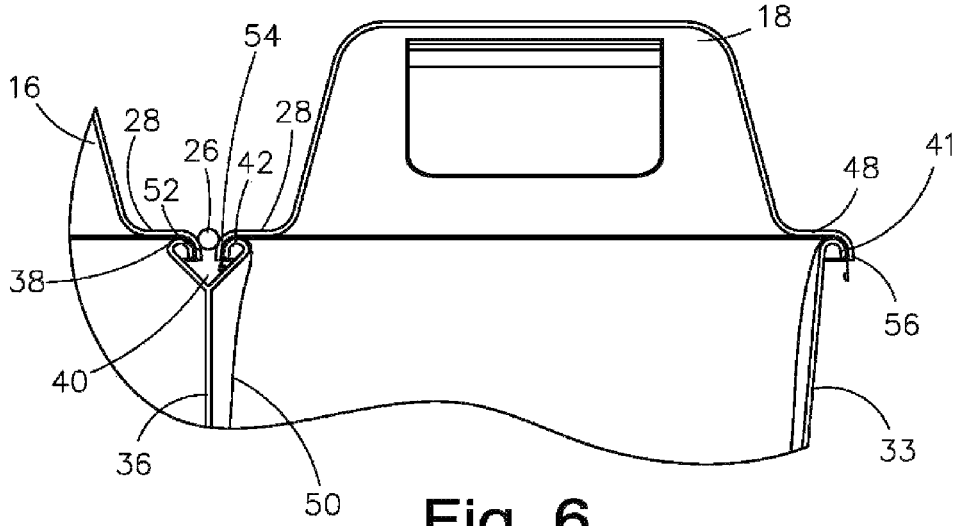
FIG. 6 shows a partial elevation cross section view showing an example of how a lid assembly connects to a bin assembly.

Now referring to FIG. 6 where a partial view of the device is shown to further include, among other features, a liner 50, a flange 52, a flange 54 and a flange 56.

The liner 50 is equivalent to and sometimes referred to as a garbage bag, trash bag, can liner or similar terminology that should be reasonably understood to encompass other analogous terminology. The liner 50 is typically made of plastic. Liners 50 are commonly sold in boxed rolls that may be inserted into the dispenser 30. Other marketable forms may be used equally and are commonly widely available.

The liner 50 is used as a disposable lining for each of the sides of the bin assembly individually. Typically one liner 50 may be used for the bin on the left and another for the bin on the right. The liner provides a removable element that protects the inside of each of the bins from soiling or contamination from the refuse contained inside the bins. The liner 50 simultaneously provides a means to easily extricate the contents of the bins with minimal effort and mess because one liner 50 can be removed without disturbing the opposing bin.

Still referring to FIG. 6, during typical use, one of the sides of the lid assembly is raised about hinge 26 (in a similar configuration as demonstrated in FIG. 3) to expose the interior of that side of the bin assembly 12. Notice that the other side of the bin assembly 12 remains undisturbed.

A liner 50 may then be inflated and inserted into a bin and hung over the rims 41 and 42 of the bin assembly 12. To hold the liner 50 firmly in place during use the liner 50 is pinched between the inside of the crown 48 between the flange 56 and rim 41. Similarly on the medial side the liner 50 is pinched between flange 54 and rim 42. The flanges 54 and 56 encircle the underside of the right half of the lid assembly 14 and engage the rims 41 and 42 that encircle the corresponding elements of the bin assembly 12. Materially similar elements are employed on the left side for the first bin as shown by flange 52 that mates with rim 38 in an analogous fashion to that on the right side.

Figure 7:
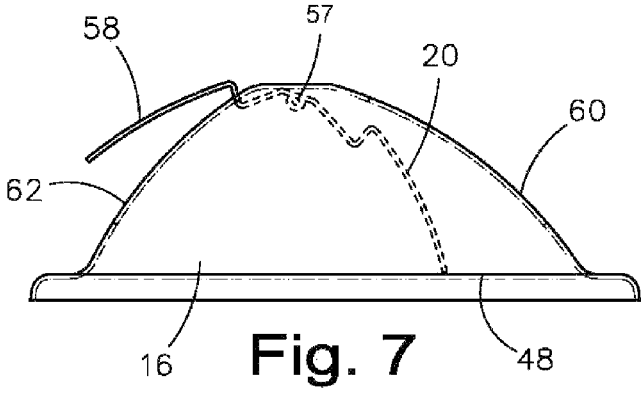
FIG. 7 is an elevation view of a version of a lid assembly.
Figure 8:
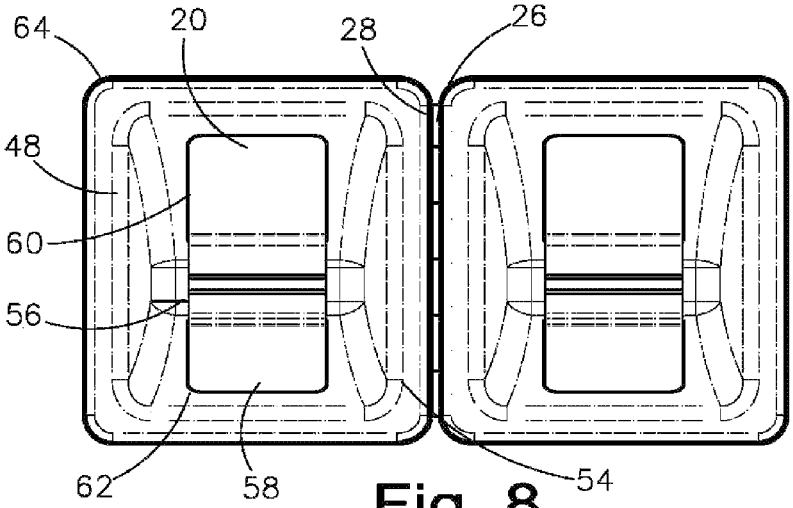
FIG. 8 is a top side plan view of a variety of lid assembly.

FIGS. 7 and 8 show an exemplary configuration of a lid assembly that further comprises, among other elements, a hinge 57, a rear door 58, an aperture 60, an aperture 62 and a flange 64. FIG. 8 is a view of the lid assembly 12 from the bottom demonstrating the interior elements in more detail.

In one important version of the lid assembly the door 20 and rear door 58 are supported and are moveable relative to hinge 57. A materially similar design may be over each of the two sides of the bin assembly 12. The weight of the rear door 58 and door 20 essentially balance at a position where the rear door 58 seals closed aperture 62 and the door 20 seals closed aperture 60. As described above it is preferable that the seals between the doors and apertures are as tight as possible to thwart insects and contain odors yet be freely moveable enough to permit easy deposits of garbage inside the bin assembly 12.

An important version of the present invention can be fairly described as a trash receptacle comprised generally of a bin assembly and a lid assembly. The bin assembly is essentially a tub, preferably made of plastic, that is formed from a bottom panel, a front panel, a rear panel, a first side panel and a second side panel, all integrated together. An important element of this version of the device is that the bin assembly further has a divider panel that is substantially parallel to said first side panel and said second side panel and bisects said bin assembly forming a first bin and a second bin. Essentially, the plastic bin is divided by this divider into two roughly equal sub-sections creating the first bin and the second bin. The first bin has a first rim encircling a top edge of said first bin and said second bin has a second rim encircling a top edge of said second bin. The first bin contains and is lined by a first liner (trash bag) with an open end of said first liner wrapped over said first rim and Said second bin similarly contains a second liner inside with the open end of said second liner wrapped over said second rim. This is in similar fashion to how in the prior art a single trash bag is placed inside the trash can and the liner wraps over the top edge of the trash can. The lid assembly is comprised of a first lid articulably connected to a second lid by a hinge. The first lid snaps onto said first rim thereby frictionally retaining (by pinching between) said first liner between the first lid and first rim. Then the second lid snaps onto the second rim thereby similarly frictionally retaining said second liner between the second lid and second rim. The hinge is substantially adjacent and parallel to a top edge of said divider panel. The first lid covers said first bin and said second lid covers said second bin, each having a door that is biased closed that can be pushed open by the user to insert trash.

An important variation or option is that a liner dispenser assembly is affixed to an exterior side of said front panel or an exterior side of said first side panel or an exterior side of said second side panel. This way additional, fresh liners are always handy.

In a preferred version the first and second bins are waterproof and leak proof. Any wet trash is then contained inside and cannot easily get out of the device. The first bin is also isolated from the second bin so that fluid in one cannot get into the other side. In other words, the first bin is fluid tight between said first panel, said divider panel, said front panel, said bottom panel and said back panel. Similarly, the second bin is fluid tight between said second panel, said divider panel, said front panel, said bottom panel and said back panel.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A trash receptacle comprised of a bin assembly and a lid assembly;

said bin assembly having integrated together a bottom panel, a front panel, a rear panel, a first side panel and a second side panel;

said bin assembly further having a divider panel that is substantially parallel to said first side panel and said second side panel and bisects said bin assembly forming a first bin and a second bin;

said divider panel has a bottom edge that contacts said bottom panel forming an impermeable barrier between said first bin and said second bin;

said first bin has a first rim entirely encircling a top edge of said first bin and said second bin has a second rim entirely encircling a top edge of said second bin;

said first bin contains a first liner with an open end of said first liner wrapped over said first rim and said second bin contains a second liner with an open end of said second liner wrapped over said second rim;

said lid assembly is comprised of a first lid articulably connected to a second lid by a hinge;

said first lid snaps onto and entirely around said first rim thereby frictionally retaining said open end of the first liner between the first lid and first rim; and said second lid snaps onto and entirely around said second rim thereby frictionally retaining said second liner between the second lid and second rim;

said hinge is substantially adjacent and parallel to a top edge of said divider panel;

said first lid covers said first bin and said second lid covers said second bin;

said first lid having a first door and said second lid having a second door;

said first door and said second door are both biased in a closed position;

said first lid is openable about said hinge to release said first liner from between the first rim and the first lid to allow access to said first bin without disturbing the second liner and said second lid is openable to release said second liner from between the second rim and the second lid to allow access to said second bin without disturbing the first liner.

2. A trash receptacle as disclosed in claim 1, further characterized in that a liner dispenser assembly is affixed to an exterior side of said front panel or an exterior side of said first side panel or an exterior side of said second side panel.

3. A trash receptacle as disclosed in claim 1, further characterized in that said first bin is fluid tight between said first panel, said divider panel, said front panel, said bottom panel and said back panel; and said second bin is fluid tight between said second panel, said divider panel, said front panel, said bottom panel and said back panel.

* * * * *